US006170653B1

(12) United States Patent
Panzner

(10) Patent No.: US 6,170,653 B1
(45) Date of Patent: Jan. 9, 2001

(54) MULTI-PHASE LAYER SYSTEM WITH PACKAGING

(76) Inventor: Barbara Panzner, Wielandstrasse 7, D-53173 Bonn (DE)

( * ) Notice: Under 35 U.S.C. 154(b), the term of this patent shall be extended for 0 days.

(21) Appl. No.: 09/424,090

(22) PCT Filed: Mar. 15, 1998

(86) PCT No.: PCT/DE98/01324

§ 371 Date: Nov. 17, 1999

§ 102(e) Date: Nov. 17, 1999

(87) PCT Pub. No.: WO98/52843

PCT Pub. Date: Nov. 26, 1998

(30) Foreign Application Priority Data

May 17, 1997 (DE) ..... 197 20 777

(51) Int. Cl.[7] ..... B65D 81/32

(52) U.S. Cl. ..... 206/210; 206/205; 206/484; 206/812

(58) Field of Search ..... 206/205, 223, 206/570, 438, 440, 441, 449, 484, 484.2, 812, 210, 209, 229; 383/200, 38, 40

(56) References Cited

U.S. PATENT DOCUMENTS

| | | | |
|---|---|---|---|
| 3,369,656 * | 2/1968 | Skinner, Jr. | 206/205 |
| 3,942,634 * | 3/1976 | Gandi et al. | 206/210 |
| 4,050,576 * | 9/1977 | Williams et al. | 206/210 |
| 4,610,357 | 9/1986 | Nakamura . | |
| 4,739,879 | 4/1988 | Nakamura . | |
| 4,796,751 * | 1/1989 | Madkour | 206/205 |
| 5,111,934 | 5/1992 | Morin . | |

FOREIGN PATENT DOCUMENTS

| | | |
|---|---|---|
| 84 36 181 | 2/1985 | (DE) . |
| 42 30 588 | 10/1993 | (DE) . |
| 295 01 519 | 5/1995 | (DE) . |
| 0 420 301 | 4/1991 | (EP) . |

* cited by examiner

*Primary Examiner*—Paul T. Sewell
*Assistant Examiner*—Luan K. Bui
(74) *Attorney, Agent, or Firm*—Akerman Senterfitt

(57) ABSTRACT

The invention relates to a multi-phase layer system with packaging, characterized in that a first layer (3) which forms an outer wall, a second layer (11) which forms a separating layer and a third layer (14) forming another outer wall are provided. A moist layer (4) is placed between the first (3) and the second layer (11) and a dry layer (13) is placed between the second (11) and the third (14) layer. All directly adjacent layers have a common, interconnected preferably soldered area. In addition, the sides of the second (11) and third (14) layer which face the inner area surrounded by the first (3) and second (11) layers are air-tight and moisture-proof.

8 Claims, 2 Drawing Sheets

MULTI-PHASE LAYER SYSTEM WITH PACKAGING

FIELD OF THE INVENTION

The present invention concerns a multi-stage pad system for the sterile administration of combined moist/dry pads.

BACKGROUND OF THE INVENTION

For certain skin disorders, such as in the case of the care of wounds, but also for cosmetic applications, combined moist and dry stage systems are required. In the case of such systems, on the one hand, a moist compress or bottom pad is present, the purpose of which consists of making direct contact with the skin and, on the other hand, a further dry compress or top pad is provided which is used in such a way that it covers over the moist pad already applied to the skin. Such multi-stage or, more precisely speaking, two-stage systems make high demands on their particular packaging: on the one hand, the sterility of the pads, above all in the medical area of application, must be ensured and, moreover, the part of the pad present in the moist form must not dry out before it is used.

For this problem, according to the present state of the art, administration forms are available which store the moist part in a leak-proof foil, for example aluminium-coated paper, sealed at the edges, such as is the case with the ointment compresses from the company of Medikom GmbH. The dry part of the pad can be stored in a paper sleeve suitable for sterile packaging and also sealed at the edge. Such systems are available on the market, for example from the company of Beiersdorf AG, Hamburg under the registered trademark of Cutisoft. If, on the basis of this state of the art, one wishes to apply a two-stage compress, one must first of all open the package with the moist pad, remove the compress and apply it to the skin area in question. Thereupon the package with the dry component must be opened, after which the latter is removed and is applied over the moist compress already applied. After this, the whole pad can then be fixed in place by, for example, sticking plaster. This way of proceeding according to the state of the art is quite laborious as the user of the pads must always use two different systems individually packaged in each case. It must be ensured that both systems are available in the correct sizes, matching each other, and are also used in the correct order. Moreover, in this way unnecessarily high packaging expenditure is incurred.

SUMMARY OF THE INVENTION

Therefore, it is the task of the present invention to state a multi-stage pad system with packaging which makes easier and less complicated handling possible for the user and at the same time permits a lower expenditure on packaging as compared with the state of the art.

This problem is solved by means of a multi-stage pad system which is, according to the invention, characterised by the fact that a first layer forming an outer wall of the packaging, a second layer forming a separating layer in the packaging, and a third layer forming a further outer wall of the packaging are provided, between the first and the second layers a moist pad, and between the second and third layers a dry pad being located, and all of the layers immediately adjacent to each other in each case showing a common area connected, preferably sealed to each other, and that, moreover, the inner space enveloped by the first and third layers is made in such a way that it is air-tight and moisture-tight. In that way sterility is maintained.

The dry pad as well as the moist pad can be made of lattice tulle or of non-woven gauze. The dry pad is designated a dry mull compress or more simply a dry compress and the moist pad is designated a moist compress, both together are, in their medical application, also designated a wound compress or wound pad.

Due to the double package in accordance with the invention the user has, on the one hand, the necessary pads for treatment and, on the other hand, he does not have to bother about the matching sizes of the pads.

Preferably the dry pad will be larger or at least as large as the moist pad is selected. In this way it is then ensured that the dry pad is always able to completely cover the moist pad and it is thus ensured that fixing means possibly additionally used, mainly sticking plasters, do not come into contact with the moist pad.

A preferred version of the present invention is characterised by the fact that the moist pad is provided with a medical active ingredient, preferably an ointment.

In this case as an active ingredient echipanthenol, for example, can be used in a concentration of 2–4 g/cm$^2$, preferably of 2.8 g/cm$^2$.

A further preferred embodiment of the present invention is characterised by the fact that for the achievement of adequate air-tightness and moisture-tightness the insides of at least one layer, e.g. of the first and second layers, are coated with plastic. Preferably, however, for this purpose an aluminium coating can also be used. Moreover, all of the other coatings or devices which are capable of producing the necessary tightness are, of course, conceivable.

The moist pad itself can, in addition to the layers of the package which envelop it, also be covered with a further piece of protective material, e.g. with a sheet of foil, both on the one side and on the other side. This helps to avoid smearing on the insides of the layers enveloping it. For this purpose, preferably pieces of material of parchment or plastic sheeting are to be provided.

A further preferred embodiment is, according to the invention, characterised by the fact that the multi-stage pad system with packaging shows at least one tearing-open or pulling device, preferably a tongue or a notch on the edge which makes it possible to open the sterile package and to separate the individual layers from one another by means of the pulling device and thus to open the inner spaces formed by these with the respective pads. In this case this notch can, for example, be at the edges (if such are present) or left running all round. This makes it quite considerably easier to tear open the package and thus to open the inner spaces with the pads in them. In the case of a notch at the corners, pulling-open is particularly easy as a result of the fact that such a device leads to diagonal complete pulling-off which is easy for the user. An opening method simple to handle makes it possible for the user to place the particular pad, while maintaining its sterility, i.e. without touching the package with the hands, on the particular part of the body, mostly a wound. Then the remainder of the package opened in this way can be withdrawn from the particular pad (both the moist one and the dry one) again.

In a particularly preferred embodiment, the present invention is characterised by the fact that the multi-stage pad system with packaging shows at least one pulling device, preferably a tongue or a notch at the edge which initially permits only the separation of the first from the second layer by means of the pulling device and thus the opening of the inner space formed by the former with the moist pad. In this case, only after the separation of the first from the second layer does at least one and preferably only one further pulling device become accessible which only then permits separation of the second from the third layer by means of the further pulling device and thus permits opening of the inner space formed by the former, with the dry pad in it. This embodiment thus imposes on the user a defined, medically appropriate order of opening of the different inner spaces. First of all, he must use the moist pad and only then the dry one, which is likewise expedient for sterility which, in the event of opening in the wrong order, is regularly endangered by the ensuing handling problems automatically occurring. A device provided in this way is, as experience shows, far better than a written notice on the package which, due either to negligence or to ignorance of the language, is only seldom read.

After application of the moist pad and of the dry pad an adequately large sticking plaster and/or some longer strips of plaster are sufficient to fix the top pad in place on the skin.

The production of the multi-stage pad system with packaging is likewise quite simple. The following steps provide one rendering of a possible production method.

On a conveyor belt the material for the moist pad, preferably a gauze strip of non-woven gauze is brought into position and evenly coated with an active ingredient, preferably echipanthenol, in a concentration of 2.8 g/cm$^2$. The application of this ointment is preferably carried out by means of the spray method, the ointment showing the necessary viscosity for this method. The belt-shaped material of the pad is, for this purpose, appropriately between 7 and 8 cm, preferably 7.5 cm wide.

Now the finely and evenly coated pad material is covered with a sheet of parchment from below and/or above. After this they are passed on to a cutter where the ointment compress (moist pad) coated on both sides in a specified width (preferably 7.5 cm) with a first and second layer is cut into equally long (likewise preferably 7.5 cm) individual compresses.

After that, now on the same belt, tangentially a first and a second strip-shaped layer is supplied as the lower and/or upper covering layer of the moist pad now covered with parchment on both sides.

Then a dry pad cut to the appropriate dimensions, preferably a multi-layer, for example a four-layer or even a six-layer dry mull compress is placed roughly in the middle on the covering layer which until then was the top layer.

The multi-stage pad system with packaging can, as a matter of principle, in every embodiment of the present invention show any geometrical shape, i.e. it can in particular be configured as rectangular, preferably square, but also circular or oval. Geometrical dimensions are also conceivable which are adapted to the shape of certain parts of the skin (for example of the nose).

Now a third layer as a further outer wall, preferably of already printed paper is brought into position and is connected, preferably sealed or glued to the lower part of the sandwich thus formed. Preferably diametrically on the suitable parts a tongue is to be provided for pulling-off.

One major advantage of the multi-stage pad system with packaging according to the present invention lies in the fact that, in the case of this two-chamber system, both a moist and a dry compress are immediately available. By simple pulling-off of the layers it is possible, while maintaining the sterility of both compresses (of the moist one and of the dry one) to arrange them cleanly on the area of skin in question and to afterwards fix them in place. The system can be used both for relatively large and also for relatively small areas of skin. It needs only to be produced in the appropriate, usual dimensions. Both acute and chronic skin disorders can be treated with it. The active ingredient can be adjusted individually to the particular needs. Not only active ingredients present in the form of ointments are conceivable for this, but also those available in liquid or powdered form. In the one case, the moist compress is impregnated with the active ingredient and then sealed in the packaging as quickly as possible before any possible evaporation, in the other case it requires a carrier substance to be applied to the compress, preferably in turn an ointment or a liquid to which the powdered active ingredient can adhere. Moreover, cosmetic applications are also conceivable, such as cosmetic packs for certain areas of the skin. Other uses for multi-stage systems which can be packaged accordingly are conceivable.

By the sealing (connecting) of combined moist/dry systems in one package sterile wound treatment also by the layman is made considerably easier. Both the dry and the moist chambers are closed to keep them sterile (for example sealed) and are exposed by preferably diagonal tearing-off of the covering film (layer). Then, first the moist and then the dry pad can be applied without problems and subsequently fixed in place preferably by means of sticking plasters.

With such an administration form, as compared with the state of the art hitherto, a considerable quantity of material is saved, namely in each case 1 layer, as only 3 layers instead of 2×2 layers are used. Hence this also simplifies production, as a result of which less energy is consumed and the burden on the environment is thus reduced. Allocation of the pads is possible automatically.

In the following embodiments to be understood as including but not limited to these are discussed on the basis of the drawing. Shown in it are:

DETAILED DESCRIPTION OF EMBODIMENTS OF THE INVENTION

Figure 1:
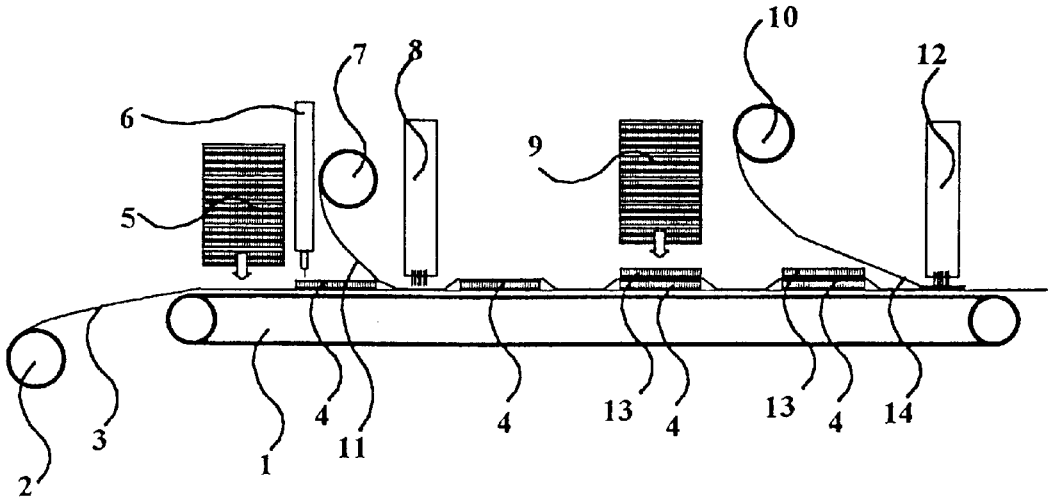
FIG. 1 a schematic representation of a possible production method for an embodiment of a multi-stage pad system with packaging according to the present invention, FIG. 2 a schematic representation of the structure of a further embodiment of a multi-phase pad system with packaging according to the present invention in a representation in perspective, and FIG. 3 a schematic representation of the structure of an embodiment of a multi-stage pad system with packaging according to the present invention which compels the user to open in a defined order, and in fact in a side view.

FIG. 1 shows a schematic representation of a possible production method of an embodiment of a multi-stage pad system with packaging according to the present invention. From a first roll 2 a first material layer (layer) 3 is fed to a conveyor belt 1. On this layer 3 pieces of pad 4 from a first pad dispenser 5 are positioned. These pads 4 are sprayed with ointment by means of an ointment spray device 6. Thus, after this process step, the moist pads 4 in the sense of the present invention are now involved. After this station, from a second roll 7 a strip-shaped second layer 11 is fed to the conveyor belt 1 which now is placed on top of the moist pads 4. After this, the first and the second layers 3, 11 are sealed to each other in the area of the edges by means of a first sealing device 8, so that they now envelop the moist pad 4. Gluing in the peripheral areas is possible, too. After this, from a second dispenser 9 further pads 13, namely those which remain dry, that is dry pads 13 in the sense of the present invention are supplied to the conveyor belt 1 in such a way that these dry pads 13 come to rest roughly in the middle above the moist pads 4 and separated from them by the second layer 11. Then from a third roll 10 a further layer 14 is supplied which is now also together with the second layer 11 able to enclose the added dry pad 13. This third layer 14 is then sealed by means of a second sealing device 12 to the second layer 11 in the area of the edges, by means of which a second chamber above the first one is formed which now contains the dry pad 13. After that the continuous belt of packages thus forming now only needs to be cut in order to obtain individual pieces according to the present invention.

Figure 2:
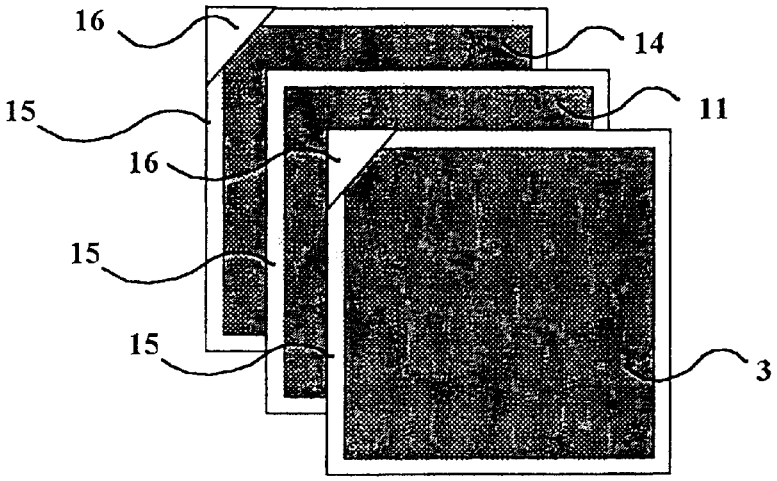

FIG. 2 shows a schematic representation of the structure of a further manifestation of a multi-stage pad system with packaging according to the present invention in a representation in perspective. In the foreground, first of all a first layer 3 can be seen which is sealed to the second layer 11 lying behind it and the further third layer 14 lying behind that over an area of the edge 15. Notches 16 are used for easier opening of this multi-stage pad system. The moist pad not illustrated here comes to rest between the first layer 3 and the second layer (intermediate layer) 11, whereas the dry pad 13 is placed between the intermediate layer 11 and the third layer 14.

Figure 3:
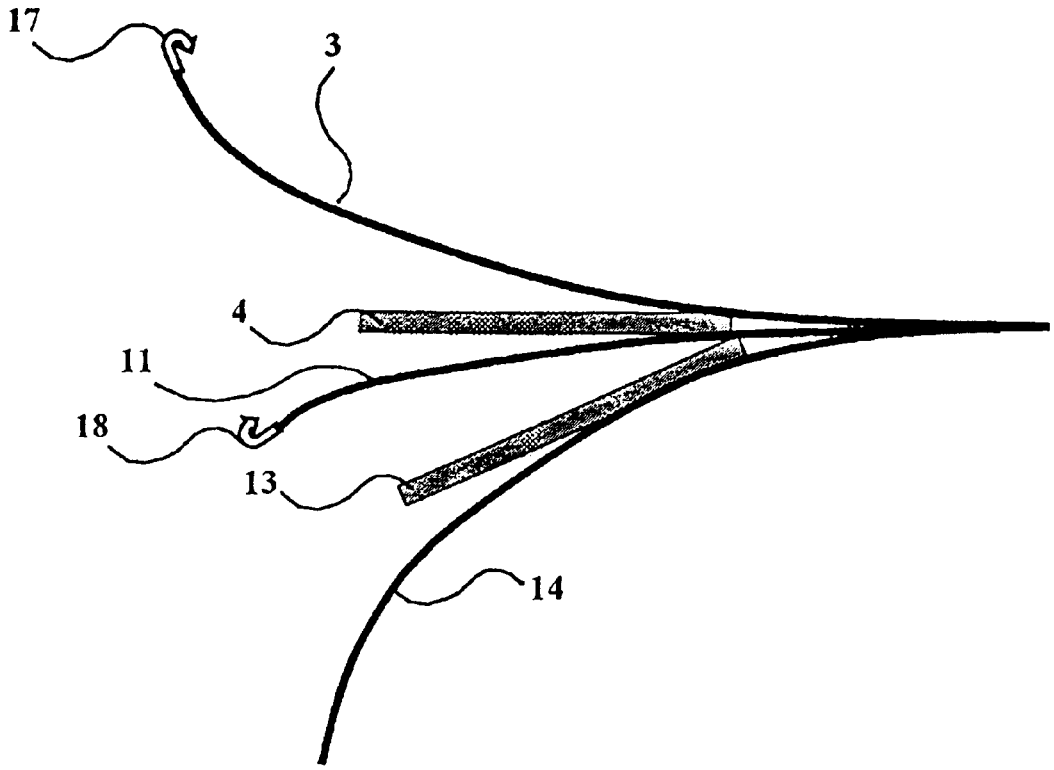

FIG. 3 shows a schematic representation of the structure of a manifestation of a multi-stage pad system with packaging according to the present invention which forces the user to apply a defined opening order, and, in fact, in a side view. Here a pulling device 17 can be seen which makes it possible to separate a first layer 3 from a second layer (intermediate layer) 11. In this state, the moist pad 4 can be removed, and only now is it also possible to actuate a further pulling device 18 covered up by the still closed layer 3, and this finally makes it possible to now also remove the dry pad 13. In this way, the user of the multi-stage pad system with packaging according to the present invention is compelled to adhere to the correct order of opening: first moist pad, then dry pad, a fact which makes the handling of the system easier.

The outer layers 3,14 are made preferably of paper (which has been appropriately treated or coated for sterility), aluminium foil, plastic sheeting. For the intermediate layer 11, for example, plastic sheeting, waxed paper, aluminium foil and glass film can be considered.

What is claimed is:

1. Multi-stage pad system with disposable packaging, which shows a first layer (3) forming an outer wall, a second layer (11) forming a separating layer and a third layer forming a further outer wall (14), between the first (3) and the second (11) layers a moist pad (4), and between the second (11) and third (14) layers a dry pad (13) being located, moreover, all of the layers immediately adjacent in each case showing a common area (15) sealed to each other, the packaging showing at least one first pulling device, including a tongue (17) or a notch (16) on the edge which makes it possible to separate the first (3) from the second (11) layer by means of the pulling device and to thus open the inner chamber formed by them with the moist pad (4) in it, characterized by the fact, that the inner chamber enveloped by the first (3) and third (14) layers is made to be air-tight and moisture-tight, in particular sterile, that the packaging shows at least one second pulling device (18) which becomes accessible only after the separation of the first (3) from the second (11) layer, the second pulling device permitting the separation of the second (11) from the third (14) layer by means of the pulling device (18) and thus the opening of the inner chamber formed by them with the dry pad (13) in it.

2. Multi-stage pad system with packaging according to claim 1, characterized by the fact that the dry pad (13) is made as lattice tulle.

3. Multi-phase pad system with packaging according to claim 1 characterized by the fact that the moist pad (4) is made as lattice tulle.

4. Multi-phase pad system with packaging according to claim 1, characterized by the fact that the dry pad (13) is larger than or at least as large as the moist pad (4).

5. Multi-stage pad system with packaging according to claim 1, characterized by the fact that the moist pad (4) is provided with a medically active ointment.

6. Multi-stage pad system with packaging according to claim 5, characterized by the fact that as the active ingredient echipanthenol is used in a concentration of about 2.8 $g/cm^2$.

7. Multi-stage pad system with packaging according to claim 1, characterized by the fact that for achieving adequate air-tightness and moisture-tightness the insides of the first (3) and second (11) layers are coated with plastic.

8. Multi-stage pad system with packaging according to claim 1, characterized by the fact that for achieving adequate air-tightness and moisture-tightness the insides of the first (3) and second (11) layers are coated with aluminium.

* * * * *